US010161019B2

(12) United States Patent
Yoshimura et al.

(10) Patent No.: US 10,161,019 B2
(45) Date of Patent: Dec. 25, 2018

(54) METALLIC FASTENER MEMBER HAVING LIGHT GOLD COLOR, AND FASTENER PROVIDED THEREWITH

(71) Applicant: YKK Corporation, Tokyo (JP)

(72) Inventors: Yasuharu Yoshimura, Toyama (JP); Takahiro Fukuyama, Toyama (JP); Kousuke Seki, Toyama (JP); Atsushi Ogihara, Toyama (JP); Chikako Hiromi, Toyama (JP); Takuya Koizumi, Toyama (JP); Itaru Hasegawa, Toyama (JP); Kazuya Akitsu, Toyama (JP); Takanori Kumei, Toyama (JP); Kouta Kido, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/537,511

(22) PCT Filed: Dec. 26, 2014

(86) PCT No.: PCT/JP2014/084673
§ 371 (c)(1),
(2) Date: Jun. 19, 2017

(87) PCT Pub. No.: WO2016/103505
PCT Pub. Date: Jun. 30, 2016

(65) Prior Publication Data
US 2017/0349976 A1 Dec. 7, 2017

(51) Int. Cl.
*C22C 9/06* (2006.01)
*A44B 19/08* (2006.01)
(Continued)

(52) U.S. Cl.
CPC ..... *C22C 9/06* (2013.01); *A44B 19/08* (2013.01); *A44B 19/46* (2013.01); *A44B 19/60* (2013.01);
(Continued)

(58) Field of Classification Search
CPC ..... C22C 9/04
(Continued)

(56) References Cited

U.S. PATENT DOCUMENTS 6,245,251 B1 6/2001 Tomiyama
6,432,556 B1 * 8/2002 Brauer ..... B32B 15/01 40/27.5
(Continued)

FOREIGN PATENT DOCUMENTS

JP H10-18046 A 1/1998
JP 10-121168 A 5/1998
(Continued)

OTHER PUBLICATIONS

English translation of JP 10-121168 as machine translated at https://www4.j-platpat.inpit.go.jp Feb. 23, 2018 (Year: 2018).*
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

A metallic fastener member has a specific color of light gold and also has high strength, discoloration resistance and high workability to withstand practical use. A metallic fastener member including a base material of a copper alloy having composition containing 1 to 30% by mass of Zn and 1 to 11% by mass of Ni, the balance being Cu and inevitable
(Continued)

impurities, wherein the metallic fastener member has a Vickers hardness of Hv 120 or more and less than Hv 220.

18 Claims, 2 Drawing Sheets

(51) Int. Cl.

| | |
|---|---|
| ***A44B 19/46*** | (2006.01) |
| ***A44B 19/60*** | (2006.01) |
| ***B21D 53/54*** | (2006.01) |
| ***C22C 9/04*** | (2006.01) |
| *A44B 19/00* | (2006.01) |

(52) U.S. Cl.
CPC ..... *B21D 53/54* (2013.01); *C22C 9/04* (2013.01); *A44B 19/00* (2013.01)

(58) Field of Classification Search
USPC ..... 148/434, 435; 420/479
See application file for complete search history.

(56) References Cited

U.S. PATENT DOCUMENTS

| | | | | |
|---|---|---|---|---|
| 2003/0110600 | A1 | 6/2003 | Kikukawa et al. | |
| 2003/0110601 | A1 | 6/2003 | Sugimoto et al. | |
| 2005/0183246 | A1* | 8/2005 | Ozaki | A44B 19/06 24/403 |
| 2012/0297583 | A1* | 11/2012 | Sugimoto | A44B 19/388 24/415 |
| 2016/0235167 | A1* | 8/2016 | Ito | A44B 1/02 |

FOREIGN PATENT DOCUMENTS

| | | | |
|---|---|---|---|
| JP | 2002-285264 | A | 10/2002 |
| JP | 2003-180410 | A | 7/2003 |
| JP | 2003-183750 | A | 7/2003 |
| JP | 2005-237532 | A | 9/2005 |
| WO | 2011/077567 | A1 | 6/2011 |

OTHER PUBLICATIONS

International Search Report, PCT Patent Application No. PCT/JP2014/084673, dated Mar. 17, 2015.
International Preliminary Report on Patentability, PCT Patent Application No. PCT/JP2014/084673, dated Jul. 6, 2017.
Japanese Industrial Standard Z8781-4, Japanese Standards Association, 2013.
ISO 11664-4, Nov. 1, 2008.

* cited by examiner

METALLIC FASTENER MEMBER HAVING LIGHT GOLD COLOR, AND FASTENER PROVIDED THEREWITH

This application is a national stage application of PCT/JP2014/084673, which is incorporated herein by reference.

TECHNICAL FIELD

The present invention relates to a metallic fastener member. The present invention also relates to a fastener provided with the metallic fastener member.

BACKGROUND ART

A slide fastener is a well-known part as an opening/closing tool for various articles. It is known that elements, which are engaging parts of the slide fastener, and stoppers can be made of metals, and particularly, those made of a copper alloy often have been used. The properties conventionally required for the fastener members made of the copper alloy are high whiteness, good smoothness, a high plating property, a high casting property and the like. As the copper alloy materials for forming the fastener, copper-nickel-zinc alloys such as nickel silver, and copper-zinc alloys such as red brass and brass are well known, and various proposals for improving these copper alloys have been made.

Japanese Patent Application Public Disclosure (KOKAI) No. H10-18046 A (Patent Document 1) discloses that to provide a method for enabling production of a slide fastener or its chains comprising copper or copper alloy elements with high glossiness and good outer surface smoothness, the elements each having composition comprising Cu: 60 to 100%, Zn: 0 to 35%, Ni: 0 to 15% and inevitable impurities are subjected to an acid treatment to smoothen the outer surfaces by immersing the elements in an acid treatment solution containing hydrogen peroxide, sulfuric acid, phosphoric acid, a surfactant and an aliphatic alcohol.

Japanese Patent Application Public Disclosure (KOKAI) No. 2003-183750 A (Patent Document 2) proposes, for the purpose of providing a copper alloy for a slide fastener having high whiteness, no nickel allergy, and good continuous casting property and casting quality, a copper alloy having composition represented by the general formula: CuaZnbMnc, where a, b, c are in mass %, a is the balance, $10 \leq b \leq 20$, $8 \leq c \leq 15$; and inevitable elements may be contained.

Japanese Patent Application Public Disclosure (KOKAI) No. 2003-180410 A (Patent Document 3) tries to improve surface whiteness, appearance decorativeness, and glossiness of copper alloy element member by subjecting the element to a combination of electrolytic plating and electroless plating. It discloses that the copper alloys that can be used include red brass, brass, and an alloy represented by the general formula: CuaZnbMncMdXe where M is at least one element selected from Al and Sn; X is at least one element selected from Si, Ti and Cr; a, b, c, d and e are in mass % and a is the balance; $0 \leq b \leq 22$, $7 \leq c \leq 20$, $0 \leq d \leq 5$, $0 \leq e \leq 0.3$; and inevitable elements may be contained.

CITATION LIST

[Patent Document 1] Japanese Patent Application Public Disclosure (KOKAI) No. H10-18046 A

[Patent Document 2] Japanese Patent Application Public Disclosure (KOKAI) No. 2003-183750 A

[Patent Document 3] Japanese Patent Application Public Disclosure (KOKAI) No. 2003-180410 A

SUMMARY OF INVENTION

Problem to be Solved by the Invention

With the diversification of user's taste in recent years, the characteristics required for the metallic fastener members also have been diversified. In such circumstances, there has been a problem that cannot be solved by the materials which have been conventionally studied. For example, although materials with high whiteness have been previously desired because most of accessories, such as rings and necklaces mainly have had white color tones, it is now expected that needs for fastener members having specific colors also will be increased. For example, it is considered that such needs will be further increased because recent luxury bags often use metallic fittings with gold colors (yellow gold color or pink gold color), and the use of metallic fasteners having the same color as the metallic fittings can thus achieve the uniformity of design. The color can be controlled by adjusting color of the plated film, but in case of the slide fastener, the plated film might peel off due to friction of the fastener members during the operation of the fastener. There is a problem of impairing the design property because the peeling of the plated film may expose the color of the base material. Further, materials vulnerable to discoloration cannot maintain good appearance, due to discoloration resulting from the long-term use. In addition, some plating solutions are expensive. On the other hand, from the viewpoint of practicality, the metallic fastener member is desired not only to have a desired color but also to have high strength and high workability for practical use.

The present invention has been made under the above circumstances. An object of the present invention is thus to provide a metallic fastener member having a specific color of light gold and also having high strength, discoloration resistance and high workability to withstand practical use. Another object of the present invention is to provide a fastener provided with such a metallic fastener member.

Means for Solving the Problem

The present inventors have intensively studied to solve the above-mentioned problems and found that a copper alloy containing predetermined amounts of Zn and Ni can develop color similar to gold with a high quality appearance (hereinafter referred to as a "light gold color"), and also exhibit high strength, discoloration resistance and high workability for practical use as a fastener member. The present invention has been completed based on the above findings.

In a first aspect, the present invention relates to a metallic fastener member comprising a base material of a copper alloy having composition containing 1 to 30% by mass of Zn and 1 to 11% by mass of Ni, the balance being Cu and inevitable impurities, wherein the metallic fastener member has a Vickers hardness of Hv 120 or more and less than Hv 220.

In one embodiment of the metallic fastener member according to the first aspect of the present invention, the copper alloy satisfies $-2<a^*<10$ and $10<b^*<19$ in the CIELAB color space according to JIS Z8781-4 (2013).

In a second aspect, the present invention relates to a metallic fastener member comprising a base material of a copper alloy having composition containing 14 to 30% by mass of Zn and 4 to 11% by mass of Ni, the balance being Cu and inevitable impurities, wherein the metallic fastener member has a Vickers hardness of Hv 120 or more and less than Hv 220.

In one embodiment of the metallic fastener member according to the second aspect of the present invention, the copper alloy satisfies $-2<a^*<2$ and $12<b^*<19$ in the CIELAB color space according to JIS Z8781-4 (2013).

In a third aspect, the present invention relates to a metallic fastener member comprising a base material of a copper alloy having composition containing 23 to 27% by mass of Zn and 4 to 8% by mass of Ni, the balance being Cu and inevitable impurities, wherein the metallic fastener member has a Vickers hardness of Hv 120 or more and less than Hv 220.

In one embodiment of the metallic fastener member according to the third aspect of the present invention, the copper alloy satisfies $-2<a^*<0$ and $15<b^*<19$ in the CIELAB color space according to JIS Z8781-4 (2013).

In a fourth aspect, the present invention relates to a metallic fastener member comprising a base material of a copper alloy having composition containing 2 to 14% by mass of Zn and 2 to 10% by mass of Ni, the balance being Cu and inevitable impurities, wherein the metallic fastener has a Vickers hardness of Hv 120 or more and less than Hv 220.

In one embodiment of the metallic fastener member according to the fourth aspect of the present invention, the copper alloy satisfies $1<a^*<10$ and $10<b^*<17$ in the CIELAB color space according to JIS Z8781-4 (2013).

In a fifth aspect, the present invention relates to a metallic fastener member comprising a base material of a copper alloy having composition containing 9 to 13% by mass of Zn and 3 to 7% by mass of Ni, the balance being Cu and inevitable impurities, wherein the metallic fastener has a Vickers hardness of Hv 120 or more and less than Hv 220.

In one embodiment of the metallic fastener member according to the fifth aspect of the present invention, the copper alloy satisfies $1<a^*<3$ and $12<b^*<15.5$ in the CIELAB color space according to JIS Z8781-4 (2013).

In a sixth aspect, the present invention relates to a metallic fastener member comprising a base material of a copper alloy having composition containing 2 to 6% by mass of Zn and 3 to 10% by mass of Ni, the balance being Cu and inevitable impurities, wherein the metallic fastener member has a Vickers hardness of Hv 120 or more and less than Hv 220.

In one embodiment of the metallic fastener member according to the sixth aspect of the present invention, the copper alloy satisfies $3<a^*<10$ and $10<b^*<17$ in the CIELAB color space according to JIS Z8781-4 (2013).

In one embodiment of the metallic fastener member according to the first to sixth aspects of the present invention, the copper alloy further contains at most 0.5% by mass of Mn.

In another embodiment of the metallic fastener member according to the first to sixth aspects of the present invention, a surface of the metallic fastener member has an arithmetic average roughness Ra of 0.1 μm or less.

In yet another embodiment of the metallic fastener member according to the first to sixth aspects of the present invention, a total content of Zn and Ni is 2% by mass or more and 36% by mass or less.

In yet another embodiment, the metallic fastener member according to the first to sixth aspects of the present invention comprises a plated film on the base material.

In yet another embodiment of the metallic fastener member according to the first to sixth aspects of the present invention, the plated film satisfies $-2<a^*<10$ and $10<b^*<19$ in the CIELAB color space according to JIS Z8781-4 (2013).

In yet another embodiment, the metallic fastener member according to the first to sixth aspects of the present invention is an element for a slide fastener.

In a seventh aspect, the present invention is a slide fastener comprising the metallic fastener member according to the present invention.

Effects of the Invention

The metallic fastener member according to the present invention has the base material itself exhibiting a light gold color which brings about good aesthetic appearance. Therefore, design property is not impaired by cutting because the cut surface after cutting has the same color as the non-cut surface. Further, there is no need for performing a plating treatment which might impair the design property due to peeling. The metallic fastener member according to the present invention can exhibit the gold color by a relatively inexpensive material containing Cu as a main component, without plating treatment, so that fastener members with a high quality appearance can be provided to users at reasonable price. Further, the metallic fastener member according to the present invention comprises the base material of the copper alloy having high strength, discoloration resistance and high workability, and it can provide high practicality in terms of productivity and service life.

Figure 1:
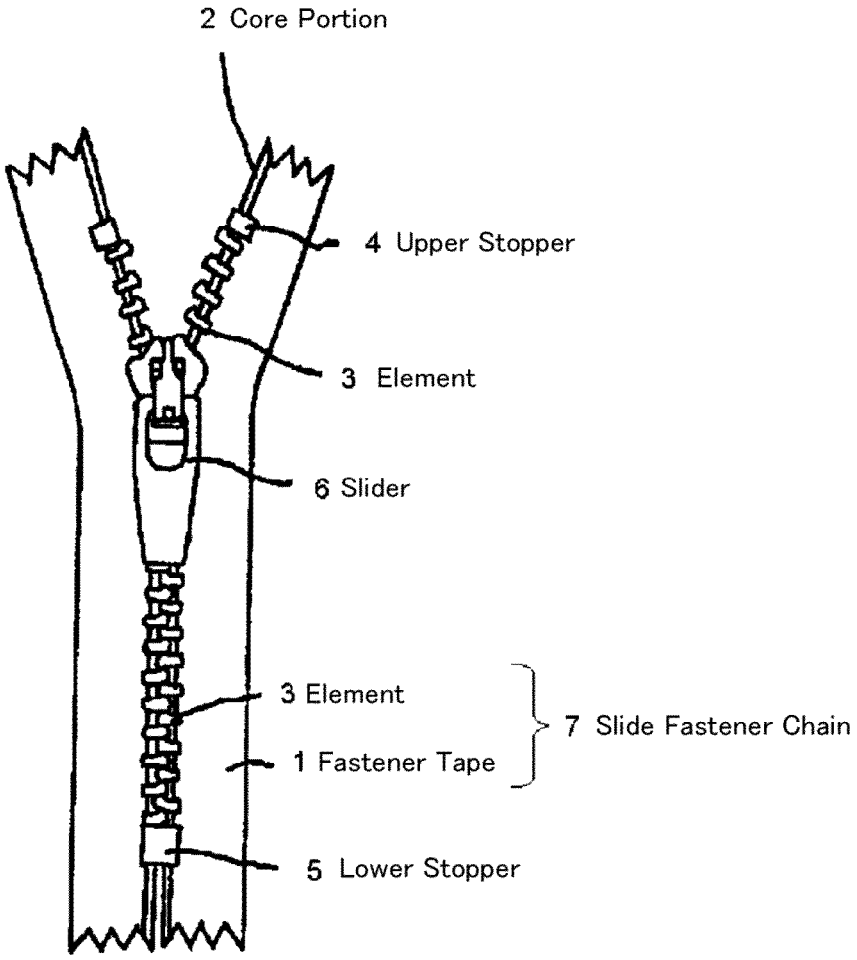
FIG. 1 is a schematic view of a slide fastener.

DETAILED DESCRIPTION OF THE PREFERRED EMBODIMENTS (Composition)

The metallic fastener member according to the present invention comprises a base material of a copper alloy containing predetermined composition, for the purpose of developing the gold color.

In one embodiment, the metallic fastener member according to the present invention comprises a base material of a copper alloy having composition containing 1 to 30% by mass of Zn and 1 to 11% by mass of Ni, the balance being Cu and inevitable impurities. The copper alloy may further contain at most of 0.5% by mass of Mn. In principle, a color tone of a copper alloy is determined depending on composition, and the copper alloy having such composition can have a color tone satisfying $-2<a^*<10$ and $10<b^*<19$ in the CIELAB color space according to JIS Z8781-4 (2013). It is noted that a* is a value indicating a magenta-green color tone (plus (+) is closer to magenta, minus (−) is closer to green), b* is a value indicating a yellow-blue color tone (plus (+) is closer to yellow, minus (−) is closer to blue).

In another embodiment, the metallic fastener member according to the present invention comprises a base material of a copper alloy having composition containing 14 to 30% by mass of Zn and 4 to 11% by mass of Ni, the balance being Cu and inevitable impurities. The copper alloy may further contain at most of 0.5% by mass of Mn. The copper alloy having such composition can have a color tone satisfying $-2<a^*<2$ and $12<b^*<19$ in the CIELAB color space according to JIS Z8781-4 (2013). Thus, in the rage of such composition, a light gold color which relatively emphasizes yellow (yellow gold color) can be obtained. Further, in yet another embodiment, the metallic fastener member according to the present invention comprises a base material of a copper alloy having composition containing 23 to 27% by mass of Zn and 4 to 8% by mass of Ni, the balance being Cu and inevitable impurities. The copper alloy having such composition can have a color tone satisfying $-2<a^*<0$ and $15<b^*<19$ in the CIELAB color space according to JIS Z8781-4 (2013). The adoption of such composition can provide the fastener member not only exhibiting the light gold color tone, but also having good balance between the strength and the workability as the material.

In yet another embodiment, the metallic fastener member according to the present invention comprises a base material of a copper alloy having composition containing 2 to 14% by mass of Zn and 2 to 10% by mass of Ni, the balance being Cu and inevitable impurities. The copper alloy may further contain at most of 0.5% by mass of Mn. The copper alloy having such composition can have a color tone satisfying $1<a^*<10$ and $10<b^*<17$ in the CIELAB color space according to JIS Z8781-4 (2013). Thus, in the range of such composition, a light gold color which relatively emphasizes red (pink or orange gold color) can be obtained.

In yet another embodiment, the metallic fastener member according to the present invention comprises a base material of a copper alloy having composition containing 9 to 13% by mass of Zn and 3 to 7% by mass of Ni, the balance being Cu and inevitable impurities. The copper alloy may further contain at most of 0.5% by mass of Mn. The copper alloy having such composition can have a color tone satisfying $1<a^*<3$ and $12<b^*<15.5$ in the CIELAB color space according to JIS Z8781-4 (2013). Thus, in the range of such composition, a light gold color which relatively emphasizes orange (orange gold color) can be obtained.

In yet another embodiment, the metallic fastener member according to the present invention comprises a base material of a copper alloy having composition containing 2 to 6% by mass of Zn and 3 to 10% by mass of Ni, the balance being Cu and inevitable impurities. The copper alloy may further contain at most of 0.5% by mass of Mn. The copper alloy having such composition can have a color tone satisfying $3<a^*<10$ and $10<b^*<17$ in the CIELAB color space according to JIS Z8781-4 (2013). Thus, in the range of such composition, a light gold color which relatively emphasizes pink (pink gold color) can be obtained.

Not only the color tone but also the strength and workability of the material are important from the viewpoint of providing the fastener member. Therefore, in order to provide a highly practical fastener member, it is desirable to understand the characteristics of each alloy element and adjust the composition of each alloy, taking into account the strength and the workability, as well as the color tone.

Zn shows an effect of changing the value of a* more than the value of b* by being added to copper, and changes the color tone of Cu to a yellowish color tone. Further, Zn also shows an effect of improving mechanical properties and work hardening properties of the alloy by solid solution strengthening, and effects of deoxidization during melt casting and decreasing the price of the fastener member. The higher content of Zn can reduce the costs and obtain higher strength. Further, this can also provide an advantage of improving oxidation resistance and castability of the molten metal. However, the excess content of Zn may impair cold workability. From this point of view, the content of Zn in a range exhibiting the yellow gold color is preferably 15% by mass or more, and more preferably 19% by mass or more, and more preferably 23% by mass or more, and it is preferably 30% by mass or less, and more preferably 27% by mass or less. In addition, the content of Zn in a range exhibiting the orange gold color is preferably 9% by mass or more, and more preferably 10% by mass or more, and still more preferably 10.5% by mass or more, and it is preferably 12.5% by mass or less, and more preferably 12% by mass or less, and still more preferably 11.5% by mass or less. Further, the content of Zn in a range exhibiting the pink gold color is preferably 2.5% by mass or more, and more preferably 3% by mass or more, and still more preferably 3.5% by mass or more, and it is preferably 5.5% by mass or less, and more preferably 5% by mass or less, and still more preferably 4.5% by mass or less.

Ni plays an important role in adjusting color tones. Ni has an effect of changing the color tone of Cu to a whitish color tone. Since Ni is hardly oxidized, it is a useful element in term of obtaining the light gold color which is superior in discoloration resistance. From this point of view, the content of Ni in a range exhibiting the yellow gold color is preferably 4% by mass or more, and more preferably 5% by mass or more, and it is preferably 11% by mass or less, and more preferably 8% by mass or less. Further, the content of Ni in a range exhibiting the orange gold color is preferably 3.5% by mass or more, and more preferably 4% by mass or more, and further preferably 4.5% by mass or more, and it is preferably 6.5% by mass or less, and more preferably 6% by mass or less, and still more preferably 5.5% by mass or less. Further, the content of Ni in a range exhibiting the pink gold color is preferably 3.5% by mass or more, and more preferably 4% by mass or more, and further preferably 4.5% by mass or more, and it is preferably 9% by mass or less, and more preferably 8% by mass or less, and still more preferably 7% by mass or less.

As with Ni, Mn has an effect of changing the color tone of Cu to a whitish color tone. Since Mn tends to be more easily oxidized than Ni and decreases discoloration resistance, it may not be positively added. However, Mn has also an effect of improving mechanical properties of the copper alloy by solid solution strengthening and has the deoxidation effect in the molten metal during melting. Therefore, if the content of Mn is up to 0.5% by mass, the addition of Mn is acceptable. The content of Mn is preferably 0.4% by mass or less, and more preferably 0.2% by mass or less, and still more preferably 0.1% by mass or less.

The inevitable impurities refers to impurities which are inherently unnecessary substances that may be present in raw materials or inevitably mixed in the manufacturing process, but are acceptable for the reason that they are present in miner amounts and have no effect on the properties. The content of each impurity element that is acceptable as the inevitable impurities is generally 0.1% by mass or less, and preferably 0.05% mass or less.

(Strength and Workability)

In one embodiment, the metallic fastener member according to the present invention has a Vickers hardness of Hv 120 or more and less than 220. The Vickers hardness in such a range is preferable in term of obtaining sufficient strength to function as elements of the metallic fastener, while maintaining the life of the molding die. Further, in the process of producing the metallic fastener elements, a Y-shaped continuous deformed wire as described below is produced. When the Vickers hardness of the metallic fastener member is within the above range, the average of Vickers hardness in the transverse section of the Y-shaped continuous deformed wire is generally Hv 120 or more and less than 220. The metallic fastener member according to the present invention includes not only the final parts such as the elements, but also the Y-shaped continuous deformed wire.

The metallic fastener element may be shaped by cold-working a round wire made of the copper alloy. When the element is shaped by the cold working, a working strain is introduced to the round wire made of the copper alloy, and the material strength is increased by work hardening, so that the strength of element can be obtained. The strength and workability of element varies depending on (1) working strain introduced to the round wire made of the copper alloy, (2) a crystal grain size in the round wire made of the copper alloy before cold working, (3) the added amounts of Zn and Ni. Therefore, these factors are important to obtain the strength and workability of elements.

When the working strain introduced to the round wire made of the copper alloy is too small, the rate of work hardening may decrease and the strength of the element cannot be obtained. On the other hand, when the working strain is excessively large, the workability may be impaired and the life of the molding die may be shortened, and in some cases, cracks may be generated in the element due to the working limit, so that the function of the metallic fastener element may be impaired.

When the crystal grain size in the round wire made of the copper alloy after a final heat treatment (in the case of the element, after the heat treatment immediately before producing the Y-shaped continuous deformed wire by cold rolling) is too small, the work hardening tends to occur in the subsequent cold processing, the workability may become worse, the life of the molding die may be shortened, and in some cases, cracks may be generated in the element due to the working limit, so that the function of the metallic fastener may be impaired. On the other hand, when the crystal grain size in the round wire made of the copper alloy before the final cold working is too large, irregularities may be generated on the surface of the element due to the crystal grain size, and the appearance of the metallic fastener may be impaired. The crystal grain size can be adjusted by the temperature and time conditions of the final heat treatment (recrystallization annealing). When the final heat treatment is performed at a higher temperature or for a longer time, the crystal grain size tends to be larger, and when the heat treatment is performed at a lower temperature or for a shorter time, the crystal grain size tends to be smaller. The crystal grain size after the final heat treatment is preferably 1 μm or more, and more preferably 10 μm or more, and still more preferably 30 μm or more. The suitable crystal grain size after the final heat treatment is preferably 200 μm or less, and more preferably 150 μm or less, and still more preferably 90 μm or less.

It is noted that the "comparative method" according to JIS H 0501: 1986 (Methods for Estimating Average Grain Size of Wrought Copper and Copper Alloys) is adopted for measuring the crystal grain size herein.

When the total amount of Zn and Ni to be added is less than 2% by mass, the Vickers hardness does not reach Hv 120, even though working strain with a rolling reduction of 70% or more is introduced by cold working, so that higher strength of the element cannot be obtained. Therefore, the total amount of Zn and Ni is preferably 2% by mass or more, and more preferably more than 10% by mass. On the other hand, if the total added amount of Zn and Ni exceeds 41% by mass, the introduction of working strain with the rolling reduction of 70% or more by cold working may locally provide a Vickers hardness of Hv 220 or higher, and may increase the working stress, so that the life of the molding die used for molding may be shortened, and the workability may become worse. Therefore, the total amount of Zn and Ni is preferably 41% by mass or less, and more preferably 36% by mass or less, and still more preferably 34.5% by mass or less.

For producing the fastener member exhibiting the strength as described above, the working strain should be introduced into the copper alloy with a rolling reduction of 70% or more, and most preferably 80% or more. The rolling reduction means the rolling reduction at the time of final rolling of the fastener member, for example, at the time of producing the Y-shaped continuous deformed wire by cold rolling after conducting the heat treatment at a temperature in a range of 300° C. to 650° C. for 1 h to 6 h, as shown in Examples as described below.

(Surface Treatment)

The metallic fastener member according to the present invention can be optionally subject to various surface treatments. For example, a smoothing treatment, a rust prevention treatment, a clear coating treatment, a plating treatment and the like can be performed.

In the process of producing the fastener members, some irregular cut traces remain on the outer surfaces through machine processing such as cutting, punching, and die machining. However, the smoothing treatment can be carried out to smoothen such outer surfaces. The smoothing treatment facilitates smooth touch of the metallic fastener member and contributes to improvement of the slidability of the slider when the fastener member is used as the slide fastener member. The smoothing treatment also has an effect of improving the aesthetic appearance with higher glossiness. The smoothing treatment includes chemical polishing treatments, which can use, for example, a chemical polishing solution containing hydrogen peroxide and sulfuric acid. Degreasing and/or pickling may be optionally carried out before or after the chemical polishing treatment.

The smoothing treatment may be preferably performed by immersing the metallic fastener members in an acid treatment solution containing hydrogen peroxide, sulfuric acid, phosphoric acid, a surfactant and an aliphatic alcohol, then washing them with water and drying them. Particularly, it may be more preferably performed by immersing the metallic fastener members such as the slide fastener elements in the acid treatment solution of an acidic aqueous solution containing hydrogen peroxide: 50 to 250 g/L, sulfuric acid: 10 to 150 g/L, phosphoric acid: 0.5 to 5 g/L, the surfactant: 0.01 to 2 g/L, and the aliphatic alcohol: 1 to 100 g/L, without degreasing the metallic fastener members. Such a smoothing treatment allows smoothing in a very short time only by a single step of immersion in the acid treatment solution. Details of such a smoothing treatment are disclosed in Japanese Patent Application Public Disclosure (KOKAI) No. H10-18046 A, which is incorporated herein by reference in its entirety.

The smoothing treatment allows an arithmetic average roughness Ra of the surface of the metallic fastener member to be 0.1 μm or less, and preferably 0.01 μm or less, and for example in a range of 0.001 to 0.1 μm. In the present invention, the arithmetic average roughness Ra of the surface is measured using a contact type surface roughness meter according to JIS B 0601 (2001).

After the smoothing treatment, further, the rust prevention treatment (a rust prevention step+a water washing step+a drying step) is preferably performed. Furthermore, after the rust prevention treatment or without the rust prevention treatment, the clear coating treatment (a coating step+a drying step) or the plating treatment can be performed to improve corrosion resistance, weather resistance and the like.

The rust prevention treatment is performed in order to prevent re-formation of oxides on the metallic fastener member surface smoothed by the acid treatment, and improve adhesion of a coating film in the subsequent clear coating or plating treatment. The rust prevention treatment is not required to be performed in case where the next step such as the clear coating or plating treatment is performed immediately after the smoothing treatment, and even in case where the other treatments are performed, as long as formation of a slight oxide does not cause a problem.

The rust prevention treatment can be performed by immersion or spraying using a benzotriazole-based aqueous solution, an organophosphate-based aqueous solution, or other rust prevention solution known in the art. In order to improve wettability of the metallic fastener member, a surfactant may be added. The water washing step after the rust prevention treatment can be omitted, as long as the rust-preventive agent does not adversely affect the fastener tape. The drying step is preferably performed by hot air or other heat sources at a temperature of 150° C. or lower which does not affect the color fastness of the fastener tape.

The clear coating treatment can enhance corrosion resistance of the metallic fastener member. For example, the clear coating treatment can be performed by applying a clear coating material to the surface of the metallic fastener member by a roll coater or other methods and then drying the coating film.

Since the metallic fastener member according to the present invention has the base material itself exhibiting the light gold color, the plating treatment is not required for taking advantage of the color of the base material. However, for the purpose of improvement of corrosion resistance or decoration, the plating treatment may be performed by various methods, such as electrolytic plating (electroless plating is preferably performed before the electrolytic plating), and dry plating such as a vacuum deposition method, sputtering method, and ion plating method.

The plating treatment with the same color as the base material can provide a merit of maintaining the design property even after the plated film peels off. In case of the plating treatment with the same color, the plated film preferably satisfies $-2<a^*<2$, $12<b^*<19$ in the CIELAB color space according to JIS Z8781-4 (2013). Further, the plated film preferably has values of a* and b* within ±2 respectively relative to a* and b* of the base material, and the plated film more preferably has values of a* and b* within ±1 respectively. The plating treatment with the same color can be performed by using substantially the same composition of the plated film as that of the base material.

As a final step, waxing may be performed in order to decrease sliding resistance. This step may be omitted, as long as the sliding resistance is sufficiently low.

(Slide Fastener)

An example of the slide fastener provided with the metallic fastener members (elements, upper stoppers and a lower stopper) according to the present invention will be specifically described with reference to the drawings. FIG. 1 is a schematic view of the slide fastener, and the slide fastener includes a pair of fastener tapes 1 each having a core portion 2 formed on one side edge of the fastener tape; elements 3 crimped and fixed (attached) onto the core portion 2 of each fastener tape 1 at predetermined intervals; upper stoppers 4 and a lower stopper 5 crimped and fixed onto the core portions 2 of the fastener tapes 1 at the upper end and the lower end of the elements 3; and a slider 6 arranged between a pair of the elements 3 opposed to each other and slidable in the up and down direction for engaging and disengaging the elements 3, as shown in FIG. 1. It is noted that a part in which the elements 3 have been attached to the core portion 2 of one fastener tape 1 is referred to as a fastener stringer, and an assembly in which the elements 3 attached to the core portions 2 of a pair of the fastener tapes 1 have been engaged with each other is referred to as a fastener chain 7.

Further, although not shown, the slider 6 as shown in FIG. 1 is produced by pressing a long plate-shaped body having a rectangular cross section in multiple steps, cutting the body at a predetermined interval to produce a slider body, and then attaching a spring and a pull tab to the slider body as necessary. The pull tab is also produced from the plate-shaped body having a rectangular cross section by punching the plate-shaped body into a predetermined shape, and crimping and fixing it to the slider body. It is noted that the lower stopper 5 may be an openable, closable and fittingly insertable tool formed of an insert pin, a box pin and a box body, so that the pair of slide fastener chains can be separated by disengagement operation of the slider.

Figure 2:
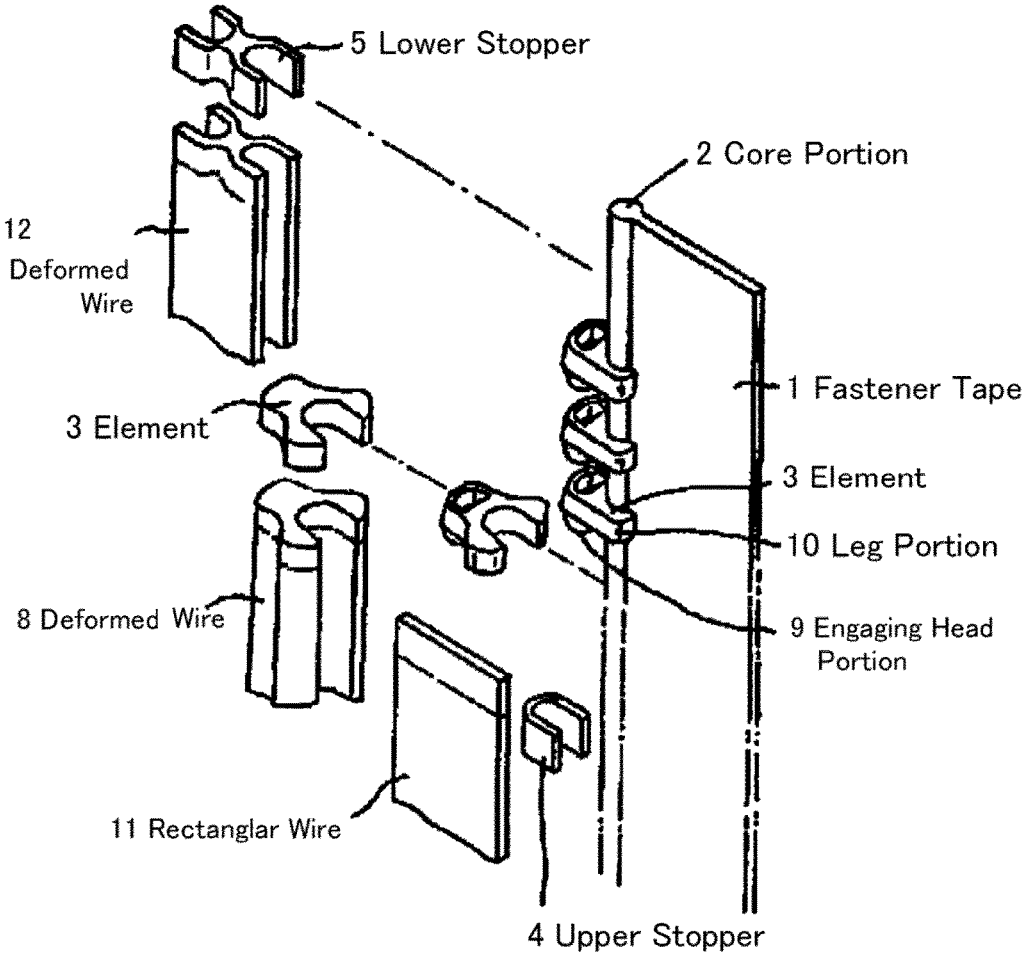
FIG. 2 is a view for explaining how to attach a lower stopper, upper stoppers, and elements to a fastener tape.

FIG. 2 shows a method for producing the elements 3, the upper stoppers 4 and the lower stopper 5 of the slide fastener shown in FIG. 1, and how to attach these members to the core portion 2 of the fastener tape 1. As shown in FIG. 2, the elements 3 are formed by cutting a deformed wire 8 having a substantially Y-shaped cross section into pieces having a predetermined dimension, and pressing the pieces to form an engaging head portion 9, and are then attached to the core portion 2 by crimping both leg portions 10 onto the core portion 2 of the fastener tape 1.

The upper stopper 4 is formed by cutting a rectangular wire 11 (rectangular wire) having a rectangular cross section into pieces having a predetermined dimension, and bending the pieces to form a substantially U-shaped cross section, and is then attached to the core portion 2 by crimping the piece onto the core portion 2 of the fastener tape 1. The lower stopper 5 is formed by cutting a deformed wire 12 having a substantially X-shaped cross section 12 into pieces having a predetermined dimension, and is then attached to the core portion 2 by crimping the piece onto the core portion 2 of the fastener tape 1.

It is noted that FIG. 2 appears to show the elements 3, the upper stopper 4 and the lower stopper 5 are simultaneously attached to the fastener tape 1, however, actually, the elements 3 are first attached continuously to the fastener tape 1 to form a fastener chain, the elements 3 attached in the regions for attaching the stoppers in the fastener chain are removed and the predetermined upper and lower stoppers 4, 5 are then attached in the regions adjacent to the element 3. Since the production and attachment are performed in such a way, the elements and the stoppers as the slide fastener members should have good cold workability. In this regard, the metallic fastener member according to the present invention shows good cold workability, for example, can be formed with a rolling reduction of 70% or more. Therefore, they are suitable as materials for elements as well as upper and lower stoppers.

The slide fastener according to the present invention can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

Although the embodiment in which the metallic fastener members according to the present invention are applied to the elements for the slide fastener has been mainly described, the metallic fastener members according to the present invention are not limited to the use of the slide fastener. They can also be applied to members for snap fasteners or other metallic fasteners.

EXAMPLES

Hereinafter, examples of the present invention are illustrated, but they are provided for better understanding of the present invention and its advantages, and are not intended to limit thepresent invention.

<Production of Fastener Chains>

Cu (purity of 99.99% by mass or more), Zn (purity of 99.9% by mass or more), and Ni (purity of 99.9% by mass or more) were prepared as raw materials. These raw materials were blended to have each of component composition according to the test number as shown in Table 1, and melted in a continuous casting machine, and continuous wires were then produced by continuous casting process. The resulting continuous wires were subjected to a wire drawing treatment with an area reduction of 70% or more and heated at a temperature in a range of 300° C. to 650° C. for 1 h to 6 h. At this time, the crystal grain sizes in the transverse section of each wire were 45 to 60 μm, as observed by the methods for estimating average grain size of wrought copper and copper alloys according to JIS H 0501. Subsequently, working strain was introduced to the wires with a rolling reduction of 70% or more by cold rolling to produce continuous deformed wires each having a substantially Y-shaped cross section. Then, various cold working processes such as cutting, pressing, bending and crimping are performed on the wires to form the elements having the dimension of "5R" defined in the catalog "FASTENING SENKA (issued by YKK Co., Ltd. on February 2009)". The elements were then attached to a polyester fastener tape to form a fastener stringer, and the opposing elements of a pair of fastener stringers were further engaged with each other to form a fastener chain.

<Smoothing Treatment>

The resulting fastener chain was immersed in an acid treatment solution at 30° C. for 2 minutes for the acid treatment. As the acid treatment solution, an acidic aqueous solution containing 1 g/L of polyoxyethylene oleyl ether as a surfactant, 80 g/L of hydrogen peroxide, 20 g/L of sulfuric acid, 0.5 g/L of phosphoric acid and 20 g/L of methyl alcohol were used. Subsequently, the acid treatment solution contained in the fastener tape was removed by vacuum dehydration in order to facilitate washing with water in the next step. Then, as the water washing step, the fastener chain was subjected to strong spraying of water, immediately followed by vacuum dehydration, followed by immersion in water, and immediately followed by vacuum dehydration. In order to sufficiently remove the acid treatment solution contained in the fastener tape, the above-mentioned washing step consisting of spraying, dehydration, immersion and dehydration was carried out three times.

<Color Tone Test>

Values of a* and b* in the CIELAB color space according to JIS Z 8781-4 (2013) were determined for the element surfaces of the fastener chain after the smoothing treatment using a colorimeter CR-300 from Minolta Co., Ltd. under the conditions of 0 to 40° C. and 85% RH or less. A pulsed xenon lamp was used as the light source. Results are shown in Table 1. The color tone was evaluated as good (○; a single circle) when $-2<a^*<10$ and $10<b^*<19$ were satisfied, and as poor (x) when they were not satisfied.

<Hardness Test>

Each continuous wire made of a copper alloy having composition according to the test number was produced in the same procedures as described above (including a wire drawing heat treatment), and processed to a Y-shaped continuous deformed wire under a condition of a rolling reduction of 70%, which corresponds to element molding. Vickers hardness (according to JIS 2244: 2009) of the transverse section of the Y-shaped continuous deformed wire was measured at a plurality of points, and evaluated on a scale of one to three based on the average of the measured values. Evaluation criteria are as follows. Results are shown in Table 1. Scale 2 is represented by ○ (a single circle) and scale 3 is represented by ◎ (a double circle).

Scale 1: Average Vickers hardness is less than Hv 120;

Scale 2: Average Vickers hardness is Hv 120 or more, and less than Hv 220; and

Scale 3: Average Vickers hardness is Hv 220 or more.

<Workability Test>

Each continuous wire made of the copper alloy having composition according to the test number was produced in the same procedures as described above, and processed under a condition of a rolling reduction of 70%, which corresponds to the element molding. Then, workability of the processed continuous wire was evaluated on a scale of one to three. The above conditions of the test simulate the production of Y-shaped continuous deformed wires by cold rolling after a heat treatment at a temperature in a range of 300° C. to 650° C. for 1 h to 6 h. This is because recrystallization generated by heat treatment loses strain once. Evaluation criteria are as follows. Results are shown in Table 1.

(1) Working Crack

Side faces of the processed wire were checked whether or not there is any crack.

(2) Working Load

From the view point that higher hardness places a higher load on the molding die, based on the above-mentioned values of Vickers hardness, the working load was evaluated as ○ (a single circle) when the Vickers hardness of the wire processed with a rolling reduction of 70% was less than 220 Hv, and as Δ (a triangle) when it was 220 Hv or more.

<Surface Roughness Test>

The arithmetic average roughness Ra of the element surfaces of the fastener chain after the smoothing treatment was measured using a contact type surface roughness meter according to JIS B 0601 (2001). All of the measured values of surface roughness were in the range of 0.02 to 0.06 μm.

TABLE 1

| | Composition | | | Color Tone of Copper Alloy | | | Workability | | | Strength | |
|---|---|---|---|---|---|---|---|---|---|---|---|
| | | | | | | | Working | Working Load | | (F Strength) | |
| | Cu | Zn | Ni | a* | b* | Color Tone | Crack Side face after a rolling reduction of 70% | Average hardness after rolling reduction of 70% | Evaluation | Average hardness after rolling reduction of 70% | Evaluation |
| Example 1 | Balance | 4.0 | 7.0 | 4.6 | 11.6 | ○ (Pink Gold) | No | 2 | ○ | 2 | ○ |
| Example 2 | Balance | 7.0 | 9.0 | 3.2 | 11.1 | ○ (Pink Gold) | No | 2 | ○ | 2 | ○ |
| Example 3 | Balance | 9.0 | 7.0 | 2.8 | 12.1 | ○ (Orange Gold) | No | 2 | ○ | 2 | ○ |
| Example 4 | Balance | 11.0 | 5.0 | 2.9 | 14.8 | ○ (Orange Gold) | No | 2 | ○ | 2 | ○ |
| Example 5 | Balance | 15.5 | 6.1 | 0.6 | 17.9 | ○ (Yellow Gold) | No | 2 | ○ | 2 | ○ |
| Example 6 | Balance | 15.5 | 8.1 | 0.6 | 16.4 | ○ (Yellow Gold) | No | 2 | ○ | 2 | ○ |
| Example 7 | Balance | 25.8 | 6.1 | −1.3 | 18.3 | ○ (Yellow Gold) | No | 2 | ○ | 2 | ○ |
| Example 8 | Balance | 26.2 | 8.0 | −1.2 | 15.3 | ○ (Yellow Gold) | No | 2 | ○ | 2 | ○ |
| Example 9 | Balance | 4.0 | 10.0 | 3.8 | 10.1 | ○ (Pink Gold) | No | 2 | ○ | 2 | ○ |
| Example 10 | Balance | 9.0 | 10.0 | 2.2 | 10.4 | ○ (Orange Gold) | No | 2 | ○ | 2 | ○ |
| Example 11 | Balance | 15.5 | 10.0 | 0.6 | 14.3 | ○ (Yellow Gold) | No | 2 | ○ | 2 | ○ |
| Example 12 | Balance | 25.4 | 10.2 | −1.1 | 13.5 | ○ (Yellow Gold) | No | 2 | ○ | 2 | ○ |
| Example 13 | Balance | 4.0 | 8.0 | 5.1 | 12.7 | ○ (Pink Gold) | No | 2 | ○ | 2 | ○ |
| Example 14 | Balance | 4.0 | 5.0 | 6.8 | 14.9 | ○ (Pink Gold) | No | 2 | ○ | 2 | ○ |
| Comparative Example 1 | Balance | 25.6 | 14.1 | −0.9 | 10 | X | No | 3 | Δ | 3 | ◎ |
| Comparative Example 2 | Balance | 0.0 | 0.0 | 13.1 | 15.5 | X | No | 1 | ○ | 1 | X |
| Comparative Example 3 | Balance | 9.7 | 0.0 | 6.9 | 20.2 | X | No | 2 | ○ | 2 | ○ |
| Comparative Example 4 | Balance | 14.6 | 0.0 | 5.4 | 19.1 | X | No | 2 | ○ | 2 | ○ |
| Comparative Example 5 | Balance | 19.6 | 0.0 | 1.3 | 21.5 | X | No | 2 | ○ | 2 | ○ |
| Comparative Example 6 | Balance | 29.7 | 0.0 | −0.5 | 23.3 | X | No | 2 | ○ | 2 | ○ |
| Comparative Example 7 | Balance | 35.0 | 0.0 | −0.9 | 29.1 | X | No | 2 | ○ | 2 | ○ |

(Discussion)

As shown in Table 1, Examples 1 to 14 provided not only the specific color of the light gold color, but also strength and workability that would withstand practical use. Further, it was confirmed that the samples of the Examples 1 to 14 had good discoloration resistance due to the presence of Ni, although no data is listed. On the other hand, in all of Comparative Examples 1 to 7, no light gold color could be obtained. Further, in Comparative Example 1, the hardness became too large, because the added amounts of Zn and Ni were too large, and in Comparative Example 2, the strength was insufficient because Zn and Ni were not added.

DESCRIPTION OF REFERENCE NUMERALS

1 fastener tape
2 core portion
3 elements
4 upper stopper
5 lower stopper
6 slider
7 slide fastener chain
8 deformed wire having a substantially Y-shaped cross section
9 engaging head portion
10 leg portion
11 rectangular wire
12 deformed wire having a substantially X-shaped cross section

What is claimed is:

1. A metallic fastener member comprising a base material of a copper alloy having composition containing 1 to 30% by mass of Zn and 1 to 11% by mass of Ni, 0 to less than 0.5% by mass of Mn and the balance being Cu and inevitable impurities, wherein the metallic fastener member has a Vickers hardness of Hv 120 or more and less than Hv 220.

2. The metallic fastener member according to claim 1, wherein the copper alloy satisfies $-2<a^*<10$ and $10<b^*<19$ in the CIELAB color space according to JIS Z8781-4 (2013).

3. The metallic fastener member according to claim 1, wherein a surface of the metallic fastener member has an arithmetic average roughness Ra of 0.1 μm or less.

4. The metallic fastener member according to claim 1, wherein a total content of Zn and Ni is 2% by mass or more and 36% by mass or less.

5. The metallic fastener member according to claim 1, further comprising a plated film on the base material.

6. The metallic fastener member according to claim 5, wherein the plated film satisfies $-2<a^*<10$ and $10<b^*<19$ in the CIELAB color space according to JIS Z8781-4 (2013).

7. The metallic fastener member according to claim 1, wherein the metallic fastener member is an element for a slide fastener.

8. A slide fastener comprising the metallic fastener member according to claim 1.

9. A metallic fastener member comprising a base material of a copper alloy having composition containing 14 to 30% by mass of Zn and 4 to 11% by mass of Ni, 0 to less than 0.5% by mass of Mn and the balance being Cu and inevitable impurities, wherein the metallic fastener member has a Vickers hardness of Hv 120 or more and less than Hv 220.

10. The metallic fastener member according to claim 9, wherein the copper alloy satisfies $-2<a^*<2$ and $12<b^*<19$ in the CIELAB color space according to JIS Z8781-4 (2013).

11. A metallic fastener member comprising a base material of a copper alloy having composition containing 23 to 27% by mass of Zn and 4 to 8% by mass of Ni, 0 to less than 0.5% by mass of Mn and the balance being Cu and inevitable impurities, wherein the metallic fastener member has a Vickers hardness of Hv 120 or more and less than Hv 220.

12. The metallic fastener member according to claim 11, wherein the copper alloy satisfies $-2<a^*<0$ and $15<b^*<19$ in the CIELAB color space according to JIS Z8781-4(2013).

13. A metallic fastener member comprising a base material of a copper alloy having composition containing 2 to 14% by mass of Zn and 2 to 10% by mass of Ni, 0 to less than 0.5% by mass of Mn and the balance being Cu and inevitable impurities, wherein the metallic fastener member has a Vickers hardness of Hv 120 or more and less than Hv 220.

14. The metallic fastener member according to claim 13, wherein the copper alloy satisfies $1<a^*<10$and $10<b^*<17$ in the CIELAB color space according to JIS Z8781-4 (2013).

15. A metallic fastener member comprising a base material of a copper alloy having composition containing 9 to 13% by mass of Zn and 3 to 7% by mass of Ni, 0 to less than 0.5% by mass of Mn and the balance being Cu and inevitable impurities, wherein the metallic fastener member has a Vickers hardness of Hv 120 or more and less than Hv 220.

16. The metallic fastener member according to claim 15, wherein the copper alloy satisfies $1<a^*<3$ and $12<b^*<15.5$ in the CIELAB color space according to JIS Z8781-4 (2013).

17. A metallic fastener member comprising a base material of a copper alloy having composition containing 2 to 6% by mass of Zn and 3 to 10% by mass of Ni, 0 to 0.5% by mass of Mn and the balance being Cu and inevitable impurities, wherein the metallic fastener member has a Vickers hardness of Hv 120 or more and less than Hv 220.

18. The metallic fastener member according to claim 17, wherein the copper alloy satisfies $3<a^*<10$ and $10<b^*<17$ in the CIELAB color space according to JIS Z8781-4 (2013).

* * * * *